US009901807B2

(12) United States Patent
Su

(10) Patent No.: US 9,901,807 B2
(45) Date of Patent: Feb. 27, 2018

(54) SHOCK-ABSORBING BUSHING OF SKATEBOARD

(71) Applicant: Yuche Su, Taipei (TW)

(72) Inventor: Yuche Su, Taipei (TW)

(73) Assignee: SOLID DESIGN & MFG. CORP., LTD., Taipei (TW)

( * ) Notice: Subject to any disclaimer, the term of this patent is extended or adjusted under 35 U.S.C. 154(b) by 0 days.

(21) Appl. No.: 15/215,596

(22) Filed: Jul. 21, 2016

(65) Prior Publication Data

US 2018/0021665 A1 Jan. 25, 2018

(51) Int. Cl.
*A63C 17/02* (2006.01)
*A63C 17/01* (2006.01)

(52) U.S. Cl.
CPC ..... *A63C 17/012* (2013.01); *A63C 17/017* (2013.01)

(58) Field of Classification Search
CPC ..... A63C 17/012; A63C 17/0046
USPC ..... 280/87.042, 11.28; 16/2.5
See application file for complete search history.

(56) References Cited

U.S. PATENT DOCUMENTS 3,862,763 A * 1/1975 Ware ..... A63C 17/02 280/11.28
4,166,629 A * 9/1979 List ..... A63C 17/012 280/11.28
4,245,848 A * 1/1981 Dudouyt ..... A63C 17/01 280/11.28
4,251,087 A * 2/1981 Hansen ..... A63C 17/01 280/11.28
4,311,319 A * 1/1982 Snyder ..... A63C 17/02 280/11.28
4,398,734 A * 8/1983 Barnard ..... A63C 17/01 280/11.28
5,853,182 A * 12/1998 Finkle ..... A63C 17/01 280/11.27
5,879,013 A * 3/1999 Shih ..... A63C 17/01 280/11.28
6,182,987 B1 * 2/2001 Bryant ..... A63C 17/0093 280/11.28
6,315,304 B1 * 11/2001 Kirkland ..... A63C 17/01 280/11.28
6,367,819 B1 * 4/2002 Andersen ..... A63C 17/0093 280/11.27
6,443,471 B1 * 9/2002 Mullen ..... A63C 17/01 280/87.042
6,467,782 B1 * 10/2002 Smith ..... A63C 17/01 280/11.28
6,474,666 B1 * 11/2002 Andersen ..... A63C 17/0093 280/11.28

(Continued)

*Primary Examiner* — Jeffrey J Restifo
(74) *Attorney, Agent, or Firm* — Invention Mine LLC

(57) ABSTRACT

A shock-absorbing bushing is provided for a skateboard and includes a first layer and a second layer. The first layer has first value of hardness. The first layer is provided with a through hole. The second layer has a second value of hardness. The second layer is coupled to an outside surface of the first layer. The first layer and the second layer are formed of plastic materials coupled together as a unitary body and exhibiting at least two different values of hardness, such as being flexible in the interior and stiff in the exterior, or being stiff in the exterior and flexible in the interior. The skateboard shock-absorbing bushing is mountable to the skateboard by for example being coupled to an axle of a retainer seat to which a roller support frame is mounted.

12 Claims, 5 Drawing Sheets

(56) References Cited

U.S. PATENT DOCUMENTS 6,739,603 B1 * 5/2004 Powell ..... A63C 17/0093 280/11.27
7,104,558 B1 * 9/2006 Saldana ..... A63C 17/0093 280/11.27
7,897,241 B2 * 3/2011 Rice ..... C08J 5/044 16/2.1
7,984,917 B2 * 7/2011 Lake ..... A63C 17/0046 280/11.27
8,998,225 B2 * 4/2015 Magee ..... A63C 17/012 280/87.042
9,010,777 B2 * 4/2015 Braden ..... A63C 17/012 280/11.28
2001/0038187 A1 * 11/2001 Reyes ..... A63C 17/012 280/87.042
2004/0145142 A1 * 7/2004 Wang ..... A63C 17/0093 280/87.042
2004/0207169 A1 * 10/2004 Kent ..... A63C 17/0093 280/87.042
2004/0245738 A1 * 12/2004 Inchley ..... A63C 17/0093 280/87.042
2006/0061054 A1 * 3/2006 Grossman ..... A63C 17/0046 280/87.042
2006/0097470 A1 * 5/2006 Chmelar ..... A63C 17/0093 280/87.042
2007/0164530 A1 * 7/2007 Horn ..... A63C 17/01 280/87.042
2009/0256324 A1 * 10/2009 Lake ..... A63C 17/0046 280/87.042
2014/0131966 A1 * 5/2014 Magee ..... A63C 17/012 280/86
2014/0151972 A1 * 6/2014 Williams ..... B60B 35/025 280/87.042
2015/0061252 A1 * 3/2015 Lininger, Jr. ..... A63C 17/0093 280/87.042
2015/0145226 A1 * 5/2015 Tolman ..... A63C 17/012 280/87.042
2015/0209652 A1 * 7/2015 Magee ..... A63C 17/012 280/86
2016/0023086 A1 * 1/2016 Aamodt ..... A63C 17/015 280/87.042

* cited by examiner

SHOCK-ABSORBING BUSHING OF SKATEBOARD

(a) TECHNICAL FIELD OF THE INVENTION

The present invention relates generally to a technical field of skateboards, and more particularly to a shock-absorbing bushing for skateboards that is formed of two plastic materials having different values of hardness so as to possess different values of hardness.

(b) DESCRIPTION OF THE PRIOR ART

A skateboard is a carrying structure that allows a user to stand thereof for propelling with the feet of the user to achieve a purpose of exercise. Further, the user standing on the skateboard may incline and/or twist his or her body, or move with run-up in order to achieve an effect of skating so that skating this way may be used as a transportation means or an entertainment means. Also, various difficult moves or actions, such as turning in air, have been developed for purposes of exhibition or competition. Skateboard, as a kind of sport, is now prevailing around the world for people of almost all ages. Being influenced by the new trend of skateboard sports around the world, the number of people participating the sport of skateboarding has greatly increased.

The most commonly known structure of skateboards available abroad and domestically includes a board with two retainer seats mounted to an underside thereof and each of the retainer seats comprises a king pin mounted thereto to support a roller frame that has two ends to which two rollers are respectively mounted so that the entire structure can support a user to stand thereon and use the feet to propel the skateboard for the purposes of exercise.

The king pin of the retainer seat is often additionally provided with a shock-absorbing pad, which is also referred to as a bushing in the field. Such a shock-absorbing pad or bushing provides cushioning for shock absorption for the purpose of turning and stabilizing the board of the skateboard. However, the conventional shock-absorbing pad is structured to show only one value of hardness and does not provide multi-layered cushioning and shock-absorbing structure. Such a known shock-absorbing pad can absorb only a very small percentage of an impact force or a vibration force applied thereto and is generally not possible to effectively cushion shocks and vibration, so that the skateboard may show poor stability and may not comfortably smoothly pass over a bend and is also hard for adjustment and correcting to the center point.

It is also noted that the conventional skateboard shock-absorbing pad possesses just one value of hardness. If the value is such that the skateboard shock-absorbing pad is considered excessively stiff, then inclining and down-pressing of the skateboard may be hard in passing a bend; on the other hand, if the skateboard shock-absorbing pad is made excessively flexible, the it is hard for the skateboard to return back to the center position. In other words, being excessively stiff and being excessively flexible both make it hard for a user to flexibly control the movement or operation of the skateboard.

Apparently, the conventional skateboard shock-absorbing pad is imperfect in the sense of cushioning and shock absorbing. Further improvement is needed.

In view of the above, the present invention aims to provide a solution to overcome the above problems.

SUMMARY OF THE INVENTION

An object of the present invention is to provide a shock-absorbing bushing of a skateboard that is formed of at least two plastic materials having different values of hardness so as to possess different values of hardness for effectively spreading an impact force or a vibration force.

To achieve the above object, the present invention provides a skateboard shock-absorbing bushing that comprises a first layer and a second layer, wherein the first layer has a first value of hardness and the first layer is provided with a through hole; and the second layer has a second value of hardness and the second layer is coupled to an outside surface of the first layer. The first layer and the second layer are formed of plastic materials that are coupled together as a unitary body and exhibiting at least two different values of hardness, such as being flexible in the interior and stiff in the exterior, or being stiff in the interior and flexible in the interior.

The skateboard shock-absorbing bushing is mountable to a skateboard, such as being coupled to a king pin of a retainer seat to which a roller support frame is mounted so that through the layers of the skateboard shock-absorbing bushing showing different hardness, it is possible to effectively spread an impact force or vibration or shocks applied thereto to provide an effect of cushioning and shock absorbing.

In an embodiment, where the first value of hardness of the first layer is set higher than the second value of hardness of the second layer to make the skateboard shock-absorbing bushing a structure having a stiff interior and a flexible exterior, at least the following advantages are achieved:

(1) The skateboard shock-absorbing bushing has an exterior portion that is relatively flexible so that in passing a bend, the support frame of the skateboard can be easily and more effortlessly pressed down and inclining to help reduce the effort that a user may spend.

(2) The skateboard shock-absorbing bushing has a relatively stiff interior portion such that after passing a bend, the down-pressing and inclining angle made in passing the bend must be returned to a neutral position and such a structure of the stiff interior helps easily return to the central position and reduce the effort that the user must spend. The skateboard shock-absorbing bushing featuring multiple-values of hardness allows a user to operate in an easy and comfortable manner.

Beneficial advantages of the present invention are that the stability of a skateboard is improved, allowing for easily and smoothly passing a bend and returning to the neutral, central position, so as to help improve the drawbacks of the conventional skateboard shock-absorbing pad resulting from a fixed value of hardness making it impossible to achieve an effective result of shock absorbing and cushioning.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1A:
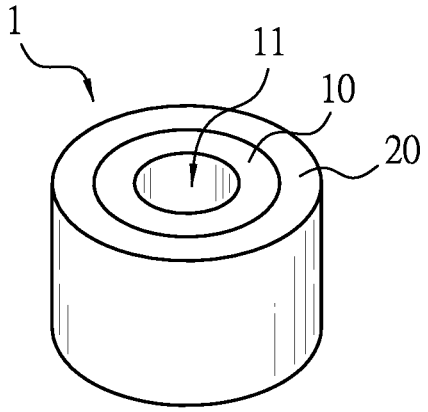
FIG. 1A is a perspective view showing a first embodiment of the present invention.
Figure 2:
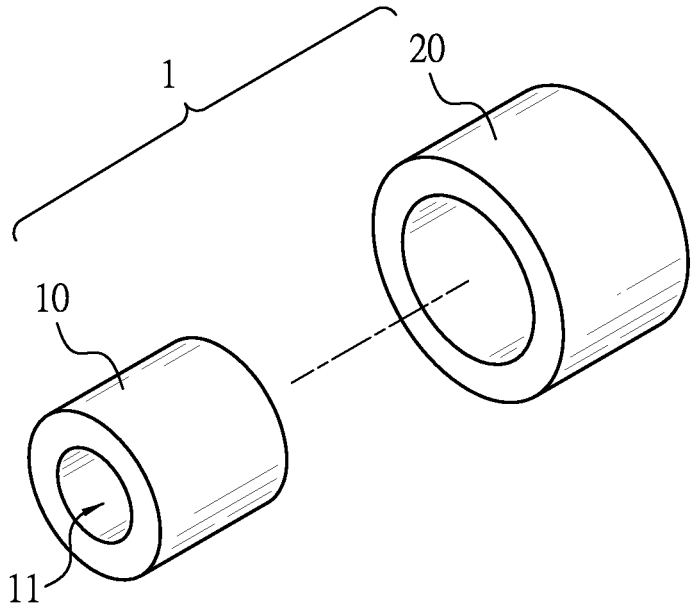
FIG. 2 is an exploded view showing the first embodiment of the present invention.
Figure 3:
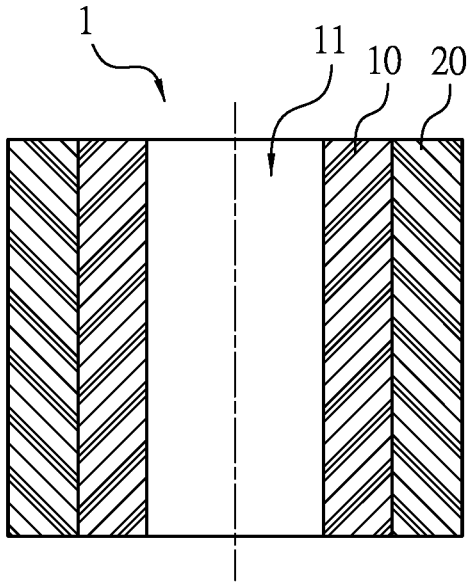
FIG. 3 is a cross-sectional view showing the first embodiment of present invention.

Referring to FIGS. 1A, 2, and 3, the present invention provides a shock-absorbing bushing, generally designated at 1, for a skateboard, and the shock-absorbing bushing comprises a first layer 10 and a second layer 20. The first layer 10 has a first value of hardness and the first layer 10 is provided with a through hole 11. The second layer 20 has a second value of hardness. The second layer 20 is coupled to an outside surface of the first layer 10. The first layer 10 and the second layer 20 are formed of plastic materials that coupled together as a unitary body that exhibits at least two different values of hardness.

In an embodiment, the first layer 10 and the second layer 20 are formed through pouring or injection of plastic materials coupled together to form a unitary body.

In an embodiment, the first value of hardness of the first layer 10 is lower than the second value of hardness of the second layer 20 so that the skateboard shock-absorbing bushing 1 is of a structure having a flexible interior (core) portion and a stiff exterior (cladding) portion.

In an embodiment, the first value of hardness of the first layer 10 is higher than the second value of hardness of the second layer 20 so that the skateboard shock-absorbing bushing 1 is of a structure having a stiff interior (core) portion and a flexible exterior (cladding) portion.

In an embodiment, the first layer 10 and the second layer 20 are formed of plastic materials having different colors and coupled together as a unitary body so that the skateboard shock-absorbing bushing 1 exhibits a multiple-layered multiple-color structure that helps improve aesthetics and provides an effect of decoration.

Figure 1B:
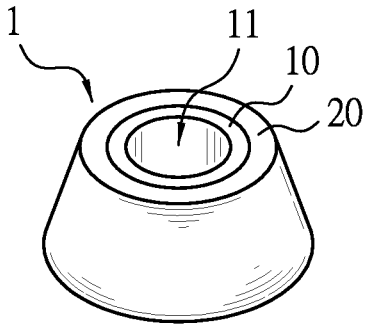
FIG. 1B is a perspective view showing a second embodiment of the present invention.

Referring to FIG. 1B, in an embodiment, the second layer 20 is structured to show an outside configuration that is of a conic shape or other different shapes (not shown) to meet the needs for different installation conditions and thus helping improve utilization thereof.

Figure 4:
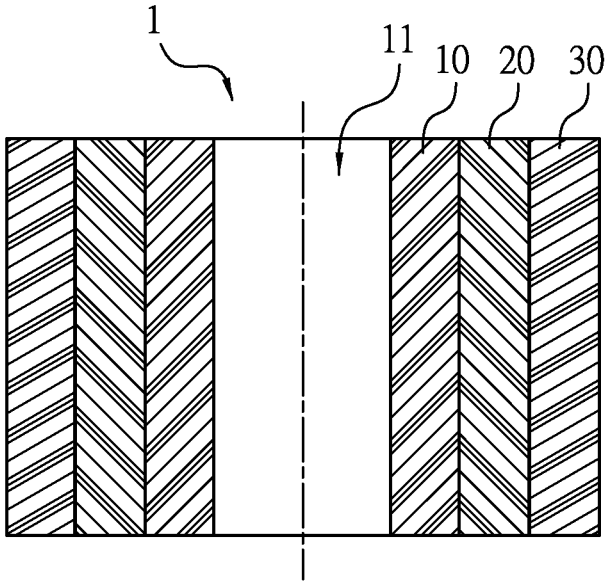
FIG. 4 is a cross-sectional view showing a third embodiment of the present invention.

Referring to FIG. 4, in an embodiment, the shock-absorbing bushing 1, which is provided for a skateboard according to the present invention, comprises a third layer 30. The third layer 30 has third value of hardness. The third layer 30 is coupled to an outside surface of the second layer 20 such that the first layer 10, the second layer 20, and the third layer 30 are formed of plastic materials that are coupled together as a unitary body that exhibits three different values of hardness.

The above provides description of constituent components of the present invention and in the following, the use, operation, principle, and effect of the constituent components will be described individually.

Figure 5:
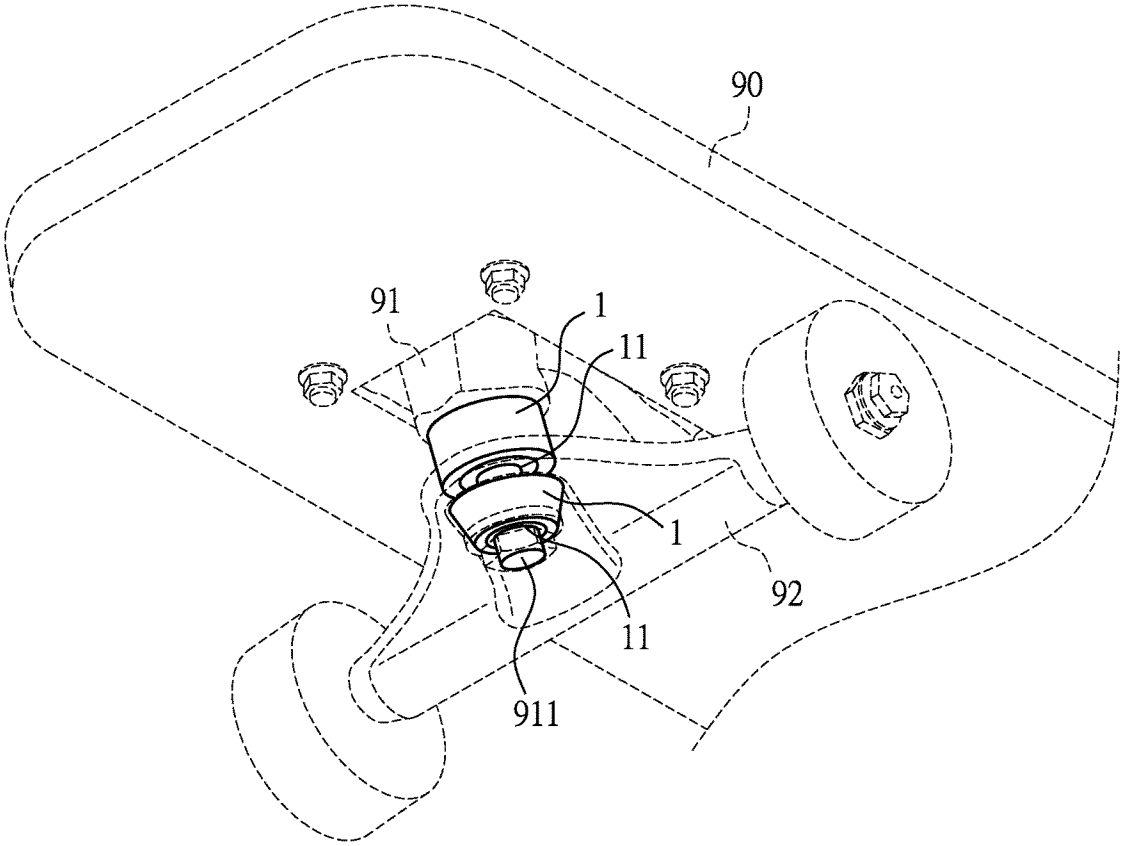
FIG. 5 is a schematic view illustrating an application of the present invention.

Referring to FIG. 5, the skateboard shock-absorbing bushing 1 of the present invention is combinable or mountable to a skateboard 90, such as being attached to a king pin 911 of a retainer seat 91 to which a roller support frame 92 is mounted and located on an underside of the skateboard 90. The skateboard shock-absorbing bushing 1 is attached to or mounted to the skateboard by having the through hole 11 fit over the king pin 911 and two are provided respectively on opposite sides of the roller support frame 92. Screwing fastener is then provided for securing these parts.

As such, the skateboard shock-absorbing bushing 1 comprises multiple layers having different hardness and thus provide multiple-layered cushioning and shock absorbing to effectively spread an impact force or vibration or shock force applied thereto and provide an effective cushioning and shock-absorbing effect.

In a case where the first value of hardness of the first layer 10 is set higher than the second value of hardness of the second layer 20 to make the skateboard shock-absorbing bushing 1 a structure having a stiff interior and a flexible exterior, such an embodiment provides at least the following advantages:

(1) The skateboard shock-absorbing bushing 1 has an exterior portion that is relatively flexible so that in passing a bend, the support frame of the skateboard can be easily and more effortlessly pressed down and inclining to help reduce the effort that a user may spend.

(2) The skateboard shock-absorbing bushing 1 has a relatively stiff interior portion such that after passing a bend, the down-pressing and inclining angle made in passing the bend must be returned to a neutral position and such a structure of the stiff interior helps easily return to the central position and reduce the effort that the user must spend. The skateboard shock-absorbing bushing 1 featuring multiple-values of hardness allows a user to operate in an easy and comfortable manner.

In other words, a conventional skateboard shock-absorbing pad has one single value of fixed hardness throughout the entirety thereof. If the skateboard shock-absorbing pad exhibit excessively stiff, then it is hard for the skateboard to be pressed down and inclining in passing a bend; and if the skateboard shock-absorbing pad is excessively flexible or soft, then it is hard for the skateboard to return to the neutral, central position, meaning being both excessively stiff or excessively flexible of the skateboard shock-absorbing pad would make a user hard to control and operate the skateboard. The present invention effectively overcomes such drawbacks of the conventional skateboard shock-absorbing pad.

Beneficial advantages of the present invention are that the stability of a skateboard is improved, allowing for easily and smoothly passing a bend and returning to the neutral, central position, so as to help improve the drawbacks of the conventional skateboard shock-absorbing pad resulting from a fixed value of hardness making it impossible to achieve an effective result of shock absorbing and cushioning.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A skateboard shock-absorbing king pin bushing, comprising:

a king pin bushing first layer, which has a first value of hardness, the king pin bushing first layer having a length and defining a through hole for receiving a king pin; and a king pin bushing second layer, which has a second value of hardness, the king pin bushing second layer encasing an outside surface of the king pin bushing first layer and extending the length of the king pin bushing first layer;

wherein the king pin bushing first layer and the king pin bushing second layer of the king pin bushing are respectively formed of plastic materials that are coupled together as a unitary body and exhibit two different values of hardness.

2. The skateboard shock-absorbing king pin bushing according to claim 1, wherein the king pin bushing first layer and the king pin bushing second layer are formed of the plastic materials through pouring or injection to be coupled together as a unitary body.

3. The skateboard shock-absorbing king pin bushing according to claim 1, wherein the first value of hardness of the king pin bushing first layer is lower than the second value of hardness of the second layer so as to provide the skateboard shock-absorbing king pin bushing with a structure having a flexible interior portion and a stiff exterior portion.

4. The skateboard shock-absorbing king pin bushing according to claim 1, wherein the first value of hardness of the king pin bushing first layer is higher than the second value of hardness of the king pin bushing second layer so as to provide the skateboard shock-absorbing bushing with a structure having a stiff interior portion and a flexible exterior portion.

5. The skateboard shock-absorbing king pin bushing body according to claim 1, wherein the king pin bushing first layer and the king pin bushing second layer are formed of plastic materials having different colors and coupled together as a unitary body so as to provide the skateboard shock-absorbing bushing with a structure of multiple layers of multiple colors.

6. The skateboard shock-absorbing king pin bushing according to claim 1 further comprising:

a king pin bushing third layer, wherein the king pin bushing third layer has a third value of hardness, the king pin bushing third layer being coupled to an outside surface of the second layer; and the king pin bushing first layer, the king pin bushing second layer, and the king pin bushing third layer are respectively formed of plastic materials that are coupled together as a unitary body exhibiting three different values of hardness.

7. A skateboard truck comprising:

a roller support frame having an axle for receiving wheels, and a flange disposed around a king pin; and a mounting bracket for attaching the roller support frame to a skateboard, the mounting bracket including a king pin protruding down from the mounting bracket, the king pin having an interior king pin bushing and a distal king pin bushing on each side of the flange, wherein the interior king pin bushing is a cylindrical shape and includes a first layer, which has a first value of hardness, the first layer having an interior length and defining a through hole for receiving the king pin; and a second layer, which has a second value of hardness, the second layer encasing an outside surface of the first layer and extending the interior length of the first layer;

wherein the first layer and the second layer of the king pin bushing are respectively formed of plastic materials that are coupled together as a unitary body and exhibit two different values of hardness; and the distal king pin bushing is a conical shape and includes a first distal layer, which has the first value of hardness, the first distal layer having a distal length and defining a distal through hole for receiving the king pin; and a second distal layer, which has the second value of hardness, the second distal layer encasing an outside surface of the first distal layer and extending the distal length of the first distal layer;

wherein the first distal layer and the second distal layer of the king pin bushing are respectively formed of plastic materials that are coupled together as a distal unitary body and exhibit the two different values of hardness.

8. The skateboard truck according to claim 7, wherein the king pin bushing first layer and the king pin bushing second layer are formed of the plastic materials through pouring or injection to be coupled together as a unitary body.

9. The skateboard truck according to claim 7, wherein the first value of hardness of the king pin bushing first layer is lower than the second value of hardness of the second layer so as to provide the interior king pin bushing and the distal king pin bushing with a structure having a flexible interior portion and a stiff exterior portion.

10. The skateboard truck according to claim 7, wherein the first value of hardness of the king pin bushing first layer is higher than the second value of hardness of the king pin bushing second layer so as to provide a structure having a stiff interior portion and a flexible exterior portion.

11. The skateboard truck according to claim 7, wherein the king pin bushing first layer and the king pin bushing second layer are formed of plastic materials having different colors and coupled together as a unitary body so as to provide a structure of multiple layers of multiple colors.

12. The skateboard truck according to claim 7 further comprising:

a king pin bushing third layer, wherein the king pin bushing third layer has a third value of hardness, the king pin bushing third layer being coupled to an outside surface of the second layer; and the king pin bushing first layer, the king pin bushing second layer, and the king pin bushing third layer are respectively formed of plastic materials that are coupled together as a unitary body exhibiting three different values of hardness.

* * * * *